United States Patent [19]

Petschulat

[11] Patent Number: 4,802,397

[45] Date of Patent: Feb. 7, 1989

[54] VIBRATO PALM REST

[76] Inventor: David J. Petschulat, 200 W. Union, Apt. #2, Fullerton, Calif. 92632

[21] Appl. No.: 3,033

[22] Filed: Jan. 14, 1987

[51] Int. Cl.[4] ..... G10D 3/18

[52] U.S. Cl. ..... 84/328; 84/313

[58] Field of Search ..... 84/313, 328, 453

[56] References Cited

U.S. PATENT DOCUMENTS

| | | | |
|---|---|---|---|
| 636,692 | 11/1899 | Patch | 84/291 |
| 3,326,072 | 6/1967 | Price | 84/313 |
| 4,100,832 | 7/1978 | Peterson | 84/313 |
| 4,137,812 | 2/1979 | Franzmann | 84/313 |
| 4,285,262 | 8/1981 | Scholz | 84/313 |
| 4,317,403 | 3/1982 | Franzmann | 84/313 |
| 4,457,201 | 7/1984 | Storey | 84/313 |
| 4,549,460 | 10/1985 | Gressett, Jr. et al. | 84/298 |

FOREIGN PATENT DOCUMENTS

| | | | |
|---|---|---|---|
| 75005 | 6/1954 | Netherlands | 84/313 |

*Primary Examiner*—Lawrence R. Franklin

*Attorney, Agent, or Firm*—Laubscher & Laubscher

[57] ABSTRACT

A palm rest for vibratos of stringed musical instruments such as guitars is disclosed, characterized in that the palm rest includes a rigid support pivotally connected at the front portion thereof with the front side edges of the vibrato. The rear of the support includes adjustable legs which space a support platform above the vibrato to provide an area for the player to rest his hand during play of the instrument. The hinged connection of the support allows it to be moved forward with the vibrato when the vibrato is rocked forward.

12 Claims, 2 Drawing Sheets

FIG. 1
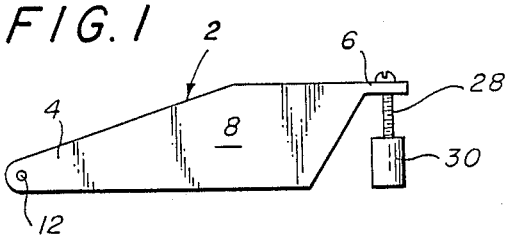
FIG. 3
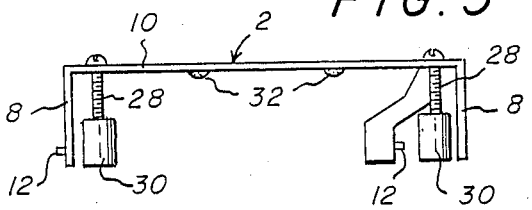
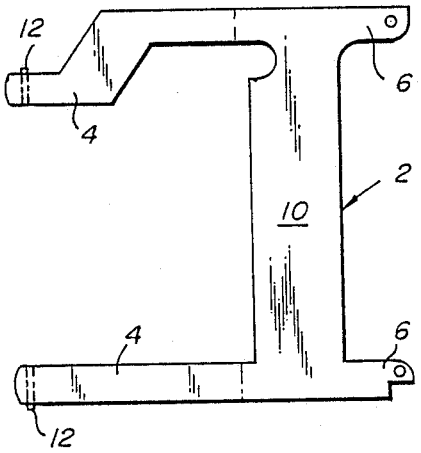
FIG. 2
FIG. 4
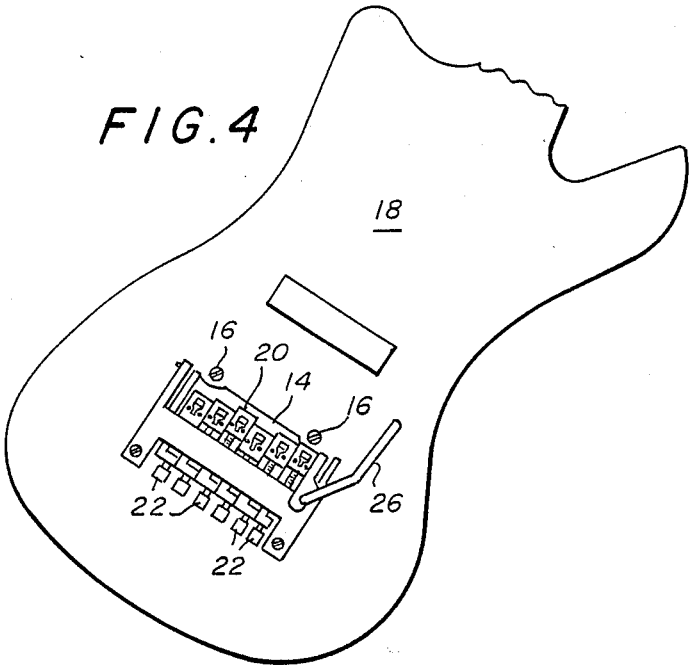
FIG. 6
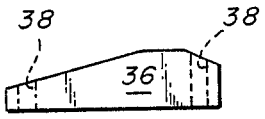
FIG. 5
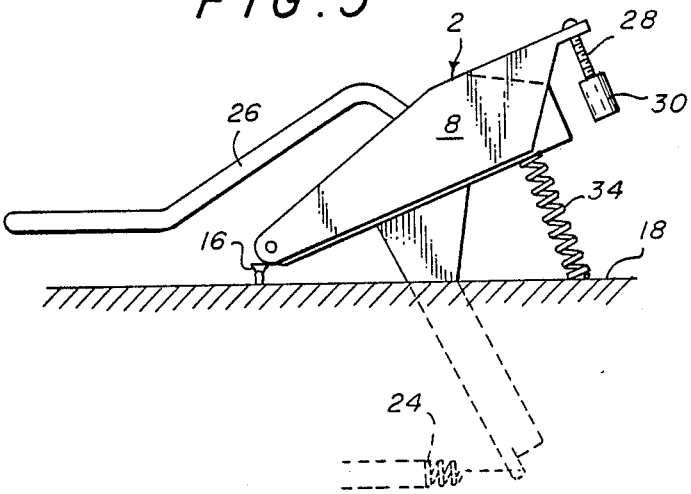
FIG. 7
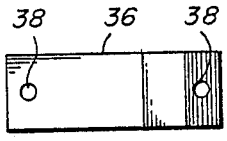
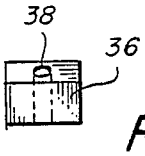
FIG. 8

FIG. 9
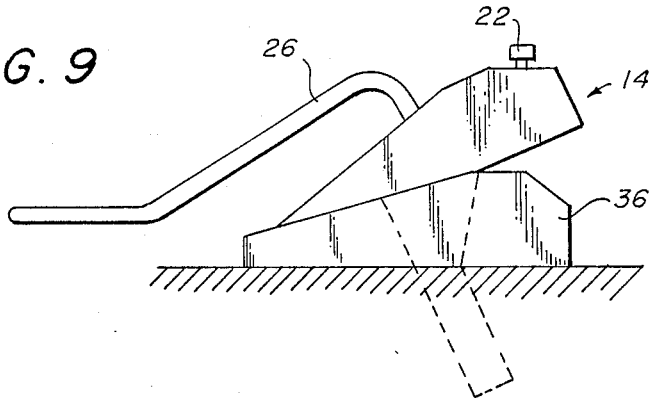
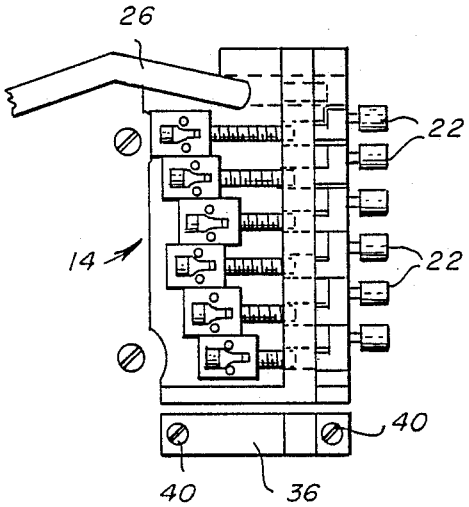
FIG. 10
FIG. 11
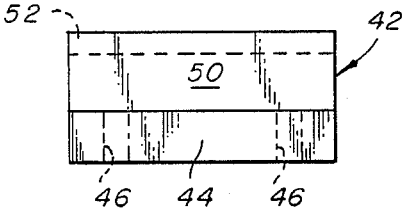
FIG. 13
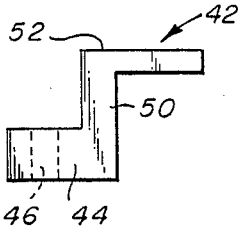
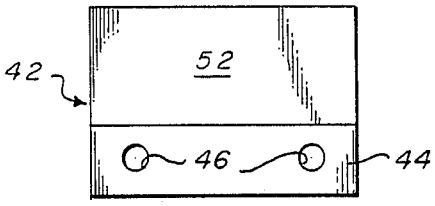
FIG. 12
FIG. 14
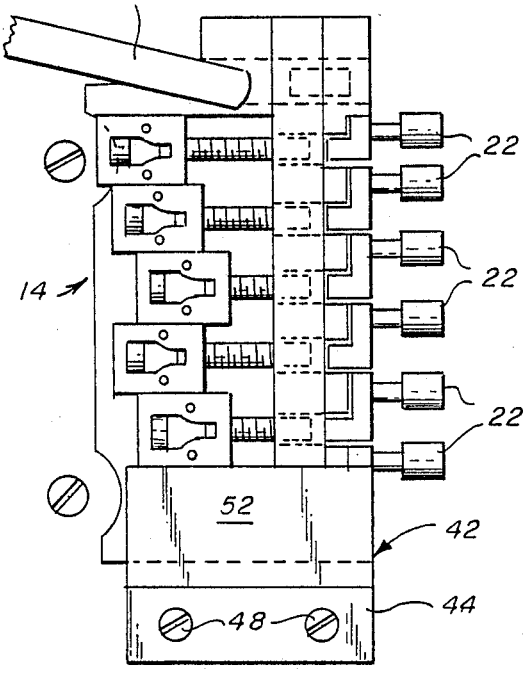
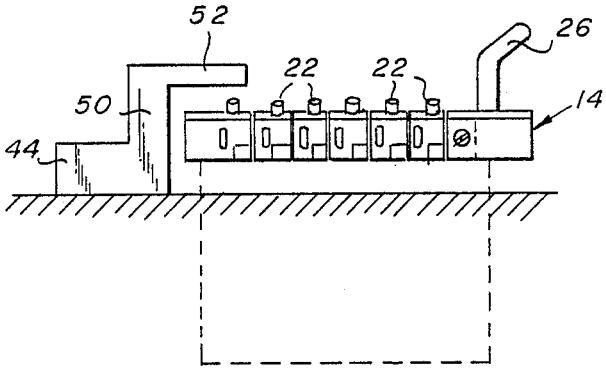
FIG. 15

VIBRATO PALM REST

BACKGROUND OF THE INVENTION

The present invention relates to a palm resting device for vibratos of stringed musical instruments such as guitars. With floating type fulcrum vibratos which pivot about a fixed stop, blade, or screw, the vibrato is normally balanced in a neutral rest position. The strings of the instrument, which are connected with the vibrato under tension, normally rotate the vibrato in one direction about the pivot point and a spring connected between the guitar and the tremolo normally rotates the vibrato in the other direction against the tension of the strings. It is often desirable for the player of the instrument to want to touch the guitar strings at or near the vibrato to partially dampen them as a musical effect. Typically, when a player rests his hand on a movable floating vibrato, the slight pressure from the hand will tilt the vibrato back and cause the instrument strings to go sharp in pitch. The present invention was designed to reduce or eliminate this undesirable vibrato movement by providing a platform or surface where the player's hand typically makes contact with the vibrato. This platform or surface is supported above the body of the guitar so that pressure exerted by the player's hand will be transmitted to the guitar body and will not affect the balance or positioning of the vibrato.

BRIEF DESCRIPTION OF THE PRIOR ART

Floating vibratos are well-known in the patented prior art as evidenced by the U.S. patents to Fender, U.S. Pat. No. 2,741,146, Rose, U.S. Pat. No. 4,171,661, and Rose, U.S. Pat. No. 4,497,236. However, none of the prior devices include any protection from undesirable movement of the vibrato resulting from inadvertent contact with the vibrato by the player's hand. The U.S. patent to Scholz, U.S. Pat. No. 4,285,262 discloses a guitar tailpiece and tremolo device including a plastic cover having openings providing an entryway for the instrument strings as well as access to a control nut for controlling tension of a leaf spring of the tremolo. Similarly, the U.S. patent to Peterson, U.S. Pat. No. 4,100,832 discloses a housing that covers an automatic tremolo mechanism and the Netherlands Pat. No. 75005 discloses a housing for covering a portion of the instrument strings as well as the tremolo device.

None of the prior tremolo housings are suitable for use with floating fulcrum type tremolos since they are incapable of moving or rotating with the tremolo when the tremolo is actuated. Furthermore, the prior covers are not suitable for use with tremolos including structure for harmonically tuning the instrument strings or for adjusting the tension of each string individually.

The present invention was developed in order to overcome these and other drawbacks of the prior devices by providing a palm rest device for a floating vibrato for a guitar which prevents contact of a player's hand with the vibrato, thereby preventing undesirable movement of the vibrato from its rest position.

SUMMARY OF THE INVENTION

Accordingly, it is a primary object of the present invention to provide a palm rest for the vibrato of a stringed musical instrument such as a guitar including a rigid support arranged above the vibrato. The support includes front leg portions connected with the forward portion of the vibrato to allow pivotal movement of the support with the vibrato when the vibrato is activated from a normal floating rest position to a pivoted position to simultaneously change the tension of the instrument strings. The support also includes rear support legs which space the support above the vibrato when the vibrato is in its normal position, whereby the support prevents the instruments player's hand from inadvertently contacting and moving the vibrato device from its normal rest position during play of the instrument.

According to a more specific object of the invention, the forward leg portions of the support are rotatably connected with the vibrato and the rear support legs normally rest on the guitar body adjacent the rear portion of the vibrato and are adjustable to vary the spacing between the support and the tremolo.

BRIEF DESCRIPTION OF THE FIGURES

Other objects and advantages of the present invention will become apparent from a study of the following specification when viewed in the light of the accompanying drawing, in which:

FIGS. 1, 2, and 3, are side, top, and rear views, respectively, of a preferred embodiment of a palm rest according to the invention;

FIGS. 4 and 5 are top and side views, respectively, of the palm rest of FIGS. 1–3 connected with the floating vibrato of a guitar;

FIGS. 6, 7, and 8 are side, top, and rear views, respectively, of a second embodiment of a palm rest according to the invention;

FIGS. 9 and 10 are side and top views, respectively, of the palm rest of FIGS. 6–8 mounted adjacent a floating vibrato;

FIGS. 11, 12, and 13 are side, top, and rear views, respectively, of a third embodiment of a palm rest according to the present invention; and FIGS. 14 and 15 are top and rear views of a floating vibrato having the palm rest of FIGS. 11–13 mounted adjacent thereto.

DETAILED DESCRIPTION

The preferred configuration of the palm rest of the present invention is shown in FIGS. 1–5. Referring first to FIGS. 1–3, the palm rest comprises a rigid support member 2 having a generally H-shaped configuration including two spaced forward leg portions 4 and two spaced rear leg portions 6. The support is preferably tapered from the rear portion toward the front, and includes downwardly extending side wall portions 8 and a top support platform 10 which bridges the opposite front and rear leg portions.

The palm rest forward leg portions each include aligned transverse openings adapted to receive pins or rods 12. As shown in FIGS. 4 and 5, the pins are connected with the side walls of a vibrato 14 adjacent the front edge thereof, whereby the palm rest support is rotatably connected with the vibrato.

The vibrato 14 is of the floating fulcrum type as disclosed in the Storey U.S. Pat. No. 4,742,750. More particularly, a pair of screws 16 are mounted in the body of a guitar 18 and the tremolo front edge portion contains a pair of recesses which receive the heads of the screws for pivotal movement thereabout. The strings (not shown) of the guitar pass over individually adjustable bridge members 20 and are connected with the vibrato, with the tension of the strings normally biasing the vibrato for rotation in one direction about the screw heads. Tuning screws 22 at the rear of the vibrato are operable to adjust the tension of the strings individually. A spring 24 is connected between the guitar body and the lower end of the vibrato for normally biasing the vibrato for rotation in the other direction about the screw heads against the tension of the springs. The vibrato is thus balanced or floats in a normal condition of operation.

The vibrato 14 includes an arm 26 which is operable to pivot the vibrato about the screw heads from its balanced position to unbalanced or activated positions to simultaneously change the tension of all of the guitar strings, thereby producing a vibrato effect during play of the instrument. The rotatable connection of the palm rest support 2 with the vibrato 14 enables the support to pivot with the vibrato.

A pair of vertically arranged threaded screws 28 are connected with the rear leg portions 6, respectively, of the palm rest support with the threaded portions of the screws extending downwardly beneath the rear leg portions as shown in FIGS. 1, 3, and 5. Threadably connected with the lower ends of the screws 28 are studs 30 which normally rest on the guitar body to the rear of the vibrato when the vibrato is in its normal balanced position. Rotation of the studs vertically adjusts them relative to the screws which enables the rear leg portions of the support to be raised or lowered relative to the guitar body, thereby adjusting the spacing of the platform 10 relative to the vibrato.

Rubber stops or spacers 32 are connected with the undersurface of the platform 10 to space the platform from the vibrato when the vibrato is actuated. More particularly, when the vibrato arm 26 is lowered, the vibrato pivots upwardly about the screw heads to decrease the tension of all of the instrument strings simultaneously. As the vibrato pivots, the rear portion thereof is raised and engages the rubber stops 32 on the platform to simultaneously raise the platform and to lift the studs 30 away from the guitar body as shown in FIG. 5, without contacting the instrument strings.

The hinged rotatable connection between the support and the vibrato enables the support platform to hover very close to the vibrato and allow the player's hand to overhang the guitar string. The front pivotal connection and rear adjustable legs eliminate the need for a large gap between the platform and the guitar strings. String dampening by the player is still possible, but the effect of hand pressure associated with string dampening is greatly reduced or eliminated entirely. The height adjustment of the legs insures that the gap or space between the vibrato and the palm rest can be properly set on any guitar with the vibrato balanced in any position.

A coil spring 34 is connected between the guitar body and the support 2 as shown in FIG. 5. The spring normally holds the palm rest support against the body of the guitar to keep the hinged palm rest support from flopping around when the player's hand is not resting on it. The spring has no effect on the vibrato, nor does it restrict the palm rest support from rocking forward with the vibrato when the vibrato is in use.

Referring once again to FIG. 4, it can be seen that the H-shaped configuration of the support affords access by the player to the adjustable bridge members 20 and the tuning screws 22 of the vibrato for harmonic and fine tuning of the instrument strings.

Referring now to FIGS. 6–10, a second embodiment of the palm rest will be described. As shown therein, the palm rest comprises a solid support block 36 which has generally the same side vertical cross-section configuration as the vibrato with which it is used. Thus for use with a vibrato such as that disclosed in the Storey U.S. Pat. No. 4,742,750, the support block has an elongated trapezoidal side cross-sectional configuration. Front and rear vertical openings 38 are provided for receiving screws 40 which are used to mount the block on the guitar body adjacent the side of the vibrato 14 as shown in FIG. 10 without interfering with the operation of the vibrato.

The third embodiment of the palm rest is shown in FIGS. 11–15. In this embodiment, the palm rest 42 has a modified S-shaped configuration as shown in FIG. 13. the lower base portion 44 of the palm rest contains a pair of openings 46 for receiving mounting screws 48 for mounting the palm rest on the guitar adjacent the side of the tremolo in a manner similar to that of the second embodiment of FIGS. 6–10. The palm rest also includes a vertical portion 50 having a height extending above the top of the vibrato a sufficient distance to allow for pivotal movement of the vibrato. Finally, the palm rest contains a top portion 52 which extends over the top of the vibrato for a significant distance to provide a platform for the player's hand without interfering with vibrato operation.

The palm rests of each embodiment are formed of a rigid metal such as cast iron, steel, brass or the like and are preferably finished to match the finish of the vibrato with which they are used. Each palm rest thus provides a platform or support surface in the area where the player's hand typically makes contact with the vibrato. The surface is supported above the body of the guitar indepenent of the vibrato so that pressure exerted by the player's hand will be transmitted to the guitar body and will not affect the balance or positioning of the tremolo.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A palm rest for the vibrato device of a stringed musical instrument such as a guitar, comprising a rigid support member arranged adjacent the vibrato device and including (1) means for movably connecting said support member adjacent the vibrato device, whereby said support member moves with the vibrato device when the device is activated from a normal floating rest position to change the tension of the instrument strings; and (2) support means for supporting said member in spaced relation adjacent the vibrato device when the device is in its normal floating rest position, whereby said support member prevents the instrument player's hand from inadvertently contacting and moving the vibrato device from its normal floating rest position during play of the instrument.

2. Apparatus as defined in claim 1, wherein said connecting means are rotatable, whereby said support member pivots with the vibrato device when the device is activated from a normal floating rest position to a pivoted position to change the tension of the instrument strings.

3. Apparatus as defined in claim 2, wherein said connecting means are arranged adjacent the pivotal axis of said vibrato device.

4. Apparatus as defined in claim 3, wherein said connecting means connect said support member to the vibrato device.

5. Apparatus as defined in claim 4, wherein said support means comprises threaded members connected with said support member and studs threadably connected with said threaed members, respectively, said studs normally resting on the body of the instrument adjacent the rear portion of the vibrato device.

6. Apparatus as defined in claim 5, wherein said threaded members and studs are arranged normal to the body of the instrument when the vibrato device is in its normal floating rest position.

7. Apparatus as defined in claim 6, wherein said support member includes forward leg portions including said connecting means and rear leg portions including said support means.

8. Apparatus as defined in claim 7, wherein said support member has a generally H-shaped configuration.

9. Apparatus as defined in claim 8, wherein said support member increases in height in the direction from said connecting means toward said support means.

10. Apparatus as defined in claim 9, wherein said support member includes spacer means which are engaged by the vibrato device during activation thereof to rotate said support means with actuation of the tremolo device while preventing contact of the support member with the vibrato device.

11. Apparatus as defined in claim 10, wherein said support member contains a recess for receiving the actuating arm of the vibrato device.

12. Apparatus as defined in claim 11, and further comprising spring means connected between said support member and the instrument body portion for normally biasing said support member toward the instrument.

* * * * *